US008733068B2

(12) United States Patent
Chrisostomidis

(10) Patent No.: US 8,733,068 B2
(45) Date of Patent: May 27, 2014

(54) WRAPPING DEVICE

(76) Inventor: Angelo Chrisostomidis, Hendra (AU)

( * ) Notice: Subject to any disclaimer, the term of this patent is extended or adjusted under 35 U.S.C. 154(b) by 763 days.

(21) Appl. No.: 11/850,328

(22) Filed: Sep. 5, 2007

(65) Prior Publication Data

US 2007/0289260 A1 Dec. 20, 2007

Related U.S. Application Data

(63) Continuation of application No. 10/487,015, filed as application No. PCT/AU02/01108 on Aug. 16, 2002, now abandoned.

(30) Foreign Application Priority Data

Aug. 16, 2001 (AU) ..... PR 7064

(51) Int. Cl.
*B65B 9/02* (2006.01)
*B65B 25/14* (2006.01)

(52) U.S. Cl.
CPC ..... *B65B 9/02* (2013.01); *B65B 25/145* (2013.01)
USPC ..... 53/429; 53/450; 53/120; 53/553

(58) Field of Classification Search
USPC ..... 53/429, 450, 117, 120, 553, 555
See application file for complete search history.

(56) References Cited

U.S. PATENT DOCUMENTS

| | | | | | |
|---|---|---|---|---|---|
| 2,541,387 | A * | 2/1951 | Salfisberg | 53/429 |
| 3,149,981 | A * | 9/1964 | Sanni | 53/117 |
| 3,439,469 | A * | 4/1969 | Van Mil, Jr. | 53/429 |
| 3,465,492 | A * | 9/1969 | Jensen | 53/120 |
| 3,977,152 | A * | 8/1976 | Rochla et al. | 53/429 |
| 4,021,993 | A * | 5/1977 | Widmer | 53/120 |
| 4,189,134 | A * | 2/1980 | Mills et al. | 53/429 |
| 4,563,859 | A * | 1/1986 | Visser | 53/450 |
| 4,773,202 | A * | 9/1988 | Felts et al. | 53/429 |
| 5,031,379 | A * | 7/1991 | Lundblad et al. | 53/120 |
| 6,305,146 | B1 * | 10/2001 | Gerber | 53/117 |
| 2004/0231295 | A1 | 11/2004 | Chrisostomidis | |

FOREIGN PATENT DOCUMENTS

| | | | | |
|---|---|---|---|---|
| DE | 2345151 | A1 * | 3/1975 | B65B 25/14 |
| EP | 324674 | A1 * | 7/1989 | B65B 61/20 |
| NZ | 204624 | | 10/1986 | |

* cited by examiner

*Primary Examiner* — Stephen F Gerrity
(74) *Attorney, Agent, or Firm* — Pitts & Lake, P.C.

(57) ABSTRACT

A device for wrapping an article, the device comprising a first feeder for a first sheet of plastics film, a second feeder for a second sheet of plastics film, a carriage for positioning the article between the first and second sheets of plastics film and a sealing mechanism for sealing the first and second sheets of plastics film together adjacent the periphery of the article.

20 Claims, 7 Drawing Sheets

WRAPPING DEVICE

CROSS-REFERENCE TO RELATED APPLICATIONS

This is a continuation application of application Ser. No. 10/487,015, filed Feb. 17, 2004, now abandoned, which was the National Stage of International Application No. PCT/AU02/01108, filed Aug. 16, 2002, which claims the benefit of Australian Provisional Application No. PR 7064, filed Aug. 16, 2001.

STATEMENT REGARDING FEDERALLY SPONSORED RESEARCH OR DEVELOPMENT

Not Applicable

FIELD OF INVENTION

The present invention is directed towards a device for wrapping an article in plastic film. The present invention is particularly directed towards folding and wrapping an article such as a newspaper or magazine.

BACKGROUND OF THE INVENTION

The present invention will be described with particular reference to a machine for wrapping newspapers, magazines and the like for home delivery, postage or sale through vending machines. However, it will be appreciated that the device may be suitable for wrapping other suitable articles and no limitation is intended thereby.

Articles such as newspapers and magazines are typically wrapped in a protective coating for home delivery or postage. A delivery agent typically throws home delivered newspapers towards a home residence. It may be some hours before the recipient collects the newspaper. Such newspapers must be bound in some way to minimize the likelihood of the paper being blown away. Traditionally, newspapers are rolled and bound by a paper sleeve or in some cases a rubber band. However, should a paper be exposed to rain or snow, the paper is subject to water damage.

In order to protect home delivered newspapers from the environment, they are often placed in a plastics envelope or are wrapped in a protective plastics film. Placing newspapers in plastics envelopes is conducted manually whereby a paper is manually folded and placed in an open ended plastic sleeve. Such a procedure is labour intensive. Further, the open end can still allow ingress of moisture into the paper should it be exposed to the atmosphere.

Wrapping machines that roll and wrap newspapers in a protective film are known. Such machines have a pair of rolling forks and a lower rolling bed. An edge of a newspaper is inserted between the two forks and rotation of the forks relative to the rolling bed winds the paper about the forks. Such machines also have an overhead film roll. A feed arm inserts and edge of the film into the nip formed as the paper begins to be rolled by the forks. At the end of the rolling step a hot wire cuts the film. The rolled and wrapped newspaper is ejected from the forks by an ejector arm. The resulting product is a tightly rolled newspaper protected by a plastics film.

There are a number of disadvantages with existing newspaper wrapping machines from both the operators and consumers point of view. First conventional wrapping machines generate a significant amount of noise. Typically the distributing newsagent wraps newspapers for home delivery on demand. Many newsagents have premises within residential areas. The noise emitted by conventional newspaper wrapping machines often exceeds acceptable noise levels.

Second, wrapping a newspaper in this manner still leaves the ends of the paper exposed. Thus where a newspaper be left out in the rain it can still become wet and damaged. A further disadvantage is that the paper and film are tightly rolled and wound together. Thus it is often difficult for a customer to separate the paper from the film. Further in cases where some time has elapsed between rolling and unwrapping, the paper retains its rolled state and is difficult to flatten out for reading.

Vending machines used for the sale of newspapers generally operate on an honest system. On insertion of the requisite fee or credit the user is provided with access to a storage container for the newspapers and is permitted to remove such number of newspapers corresponding to the fee or credit inserted. In use, and without suitable monitoring, it is open for the user to remove more newspapers than permitted.

It is therefore an object of the present invention to provide a device for wrapping an article such as a newspaper or magazine that may overcome one or more of the above disadvantages or provide the public with a useful or commercial choice.

DESCRIPTION OF THE INVENTION

According to a first broad form of the invention there is provided a device for wrapping an article, the device comprising a first feeder for a first sheet of plastics film, a second feeder for a second sheet of plastics film, a carriage for positioning the article between the first and second sheets of plastics film and a sealing mechanism for sealing the first and second sheets of plastics film together adjacent the periphery of the article.

Any suitable article may be wrapped using the device of the present invention. In the preferred embodiment the article is a foldable article and is folded for wrapping, preferably as part of the wrapping process. Suitable foldable articles include paper products such as newspapers and magazines and also textile products such as sheets, towels and the like. In addition to the foldable article additional articles may also be incorporated with the foldable article in the wrapping process. For example, in the packaging of newspapers, sample products such as CD's, sample packets of consumer products such as shampoos, cleaning materials, toothpaste, snack foods, tea or coffee sachets and the like may be fed with the foldable article for wrapping. As will be described hereunder, the carriage that positions the foldable article may also be used to introduce additional articles such as the samples. Alternatively, a separate carriage may be used for introducing additional articles.

The device comprises a first feeder for a first sheet of plastics film and a second feeder for a second sheet of plastics film. Whilst any convenient form of feeder may be used for feeding the sheets of plastic film, it is preferred that the plastics films be fed from rolls. The rolls may be mounted for counter rotation or co-rotation dependant upon the construction of the device. In the preferred embodiment, the article is positioned vertically between the first and second sheets of plastics film. In this embodiment the rolls may be horizontally disposed and aligned on the same horizontal plain. However, it is within the scope of the invention that the rolls be disposed at different heights as may be convenient dependent upon the configuration of the device. In one configuration of the device of the preferred embodiment of the present invention rolls of the device are horizontally aligned and the article can pass equidistant between them. Typically prior to wrapping the article, the leading edges of the respective plastic rolls are joined which effectively form a plastics barrier between the rolls. The rolls may be mounted for rotation whereby the film is drawn from the rolls as the article passes therethrough. As the article passes between the rolls, it contacts the barrier and film is drawn from the rolls. Alternatively the rolls may be driven to counter rotate as an article passes through the space between the rolls.

In an alternate embodiment the rolls from which the first and second sheets of plastic film are fed may be disposed vertically and the sheets of plastic film fed in a horizontal direction. The article may be moved vertical by the carriage to a position between vertical sheets of plastic film drawn horizontally.

The sheets of plastics film may be selected from a wide variety of films and the selection of sheet material is not narrowly critical provided that the selected plastic sheet may be readily sealed to another such sheet during the wrapping process. It is preferred that the sheets of plastics material be transparent so that any advertising material placed within the package may be highly visible. For example, when packaging newspapers it is desirable that the mast head be disposed on the outer surface of the folded newspaper and visible to the consumer. In one preferred embodiment the plastics film is a polyethylene film whereby the polyethylene film is adapted for welding to other such sheets using a heated strip.

The carriage for positioning the article between the first and second sheets of plastics film may be of many convenient configuration, depending upon the nature of the articles to be positioned between the sheets. In the preferred embodiment wherein the article is fed vertically between two sheets of plastics material the configuration of the carriage depend upon the nature and weight of the article. In a preferred embodiment the leading edges of the respective plastic sheets are sealed together and the article is positioned by the carriage adjacent the seal and pushed downwards whereby the respective plastic sheets envelop the article. Strength and thickness of the plastic film and the force required to draw film from the rolls may require the adaptation of this process. In a simple form of the device, the article may simply be gravity fed between the rollers. However, it is preferred that the device includes means for positively controlling passage of the article between the rolls. For lightweight articles such as newspapers and magazines, the device typically includes a push arm. The push arm can push on the article or in the cases of thin article such as magazines can push directly on the plastic barrier. For heavier articles (such as bundles or reams of paper) the device may include a support arm, located below the plastics barrier which can take the weight of the article (to avoid tearing of the plastics) and lower the article at a desired rate and to a desired position.

In a particularly preferred embodiment the device can also operate to fold a foldable article prior to wrapping. In this embodiment the device includes a feeding tray with elongate slot and a pushing arm. An article to be folded is placed on the tray and the pushing arm pushes the article at an intermediate position through the elongate slot, thereby folding the article as it is forced through the slot. Typically the pushing arm assists in drawing film from the rolls as the folded article passes between the rolls.

The thickness of the slot will be dependent upon the thickness of the article to be folded and also the stiffness of the article. The thicker the article, clearly the wider the slot will need to be to accommodate the article as it is pushed therethrough. Further, the more resilient or stiff the article is the wider the slot will preferably be in order to accommodate the ready pushing of the article therethrough. It is preferred that guide rolls, guide plates or guide rails are disposed below the tray to retain the article in the folded condition where the nature of the article is such that it is not readily contained in the folded condition by the respective sheets between which it is placed. The guide rails or guide plates may form part of the sealing mechanism. In one embodiment the guide rails and guide plates may be moveable between an operative position wherein the respective guides retain the article in the folded condition and a receiving condition wherein the guides are disposed away from the article so that the article may be readily pushed through the elongate slot.

The carriage used to position the primary article may also be used to feed additional articles for incorporation into the package. For example sample products may be introduced along with newspapers or other printed material for distribution to the consumers. Alternatively, a second carriage may be used to introduce additional materials into the package. Any convenient form of carriage may be used.

The wrapping device of the present invention includes a sealing mechanism for sealing the first and second sheets of plastics film together adjacent the periphery of the article.

The device further includes a sealing means moveable from a free position to a sealing position. Typically the means is substantially U-shaped for sealing the remaining periphery of the package. Where the leading edges of the respective sheets are sealed prior to the positioning of the article therebetween the sealing means may comprise two side sealing means and an upper sealing means. The respective sealing means may employ any convenient sealing process dependent upon the nature of the plastics material used to form the plastic sheets. In a preferred embodiment heat sealing is used whereby a heated arm is pressed against the respective sheets and the plastics material of the respective sheets is melted by the arm to form a heat seal. Alternatively, ultrasonic welding of the plastic sheets may be employed in the present invention. It is particularly preferred that heat sealing is used due to the simplicity of the heat sealing process.

The process of producing the packaged articles enables the packages to be left interconnected by the respective sheets of plastic film between the packaged articles. This may be useful in the transport and handling of the articles. Alternatively the packaged articles may be separated during the wrapping process. The device may include a separating means whereby after or during the sealing process the respective sheets of plastic are severed such that the wrapped article is separated from the rolls of sheet material. A blade may be incorporated into the device such that whilst the heat sealing is being effected the blade runs laterally across the sheets of plastic and severs them.

In a further alternate embodiment the sheets of plastics material between the wrapped articles may be partially severed to form a frangible member that may be readily torn. A plurality of articles joined in this manner may be used to charge a vending machine whereby a consumer is permitted to access a packaged article and remove it by tearing the frangible section.

In a preferred embodiment the upper arm can both seal and separate the film from the rolls and the two side arms seal the film about the ends of the article. In this way, the article can be completely sealed. Typically the arm can also reseal the separated ends of the plastics rolls to reform the plastics barrier, ready to receive another article for wrapping. The arm typically seals against an opposed plate, which plate is typically stationary, although may of course be movable towards the sealing arm.

After the sealing step the arm may be moved back to the free position.

The present invention provides a set of articles wrapped between first and second sheets of plastics film wherein said first and second sheets of plastics materials are sealed together around each article and a frangible connection is provided between each of said sealed articles. It is preferred that the articles are folded articles, in particular that the articles are folded newspapers.

In a particular form of the device of the present invention a newspaper is fed onto a table having an elongate slot. The elongate slot is positioned intermediate the newspaper so that by an arm being pushed from above the newspaper through the slot, the newspaper is folded and positioned between a pair of opposed sheets of plastics film. The folded newspaper is pressed against a presealed section of the plastics sheets. The presealed section is formed adjacent the leading edges of the sheets of plastics films. By pushing the newspaper against the presealed section the respective sheets envelop the folded newspaper. Once the arm has positioned the folded newspaper the folded arm is withdrawn and a moveable plate engages a sheet of plastics film and presses the respective sheets of plastic film and the folded newspaper against another plate. The other plate may be moveable or fixed. At least one of the plates has a slot therethrough that extends around the periphery of the newspaper such that heated arms may be pressed therethrough against the film of plastics material to effect the sealing of the folded newspaper within the plastic sheets. It is preferred that a further slot is provided spaced apart and above the top seal so as to provide the preseal for the following newspaper. Intermediate the respective top seals and in the spaced apart region a blade may be provided to run across the plastics films on a shuttle or the like. The blade may completely sever the packaged newspaper from the film or may provide a partial sever in the form of a frangible section.

In one preferred form there is provided a device including a pair of opposed rolls of a plastics film, the rolls being mounted for counter rotation, means for feeding an article to be wrapped between the rolls of film in a substantially vertical direction, means for drawing film from the rolls and about the article as the article passes between the rolls, and a sealing and separating arm moveable from a free position to a sealing and separating position after the article has passed between the rolls so as to seal the film about the article.

According to a further broad form of the invention there is provided a method of wrapping an article, the method including providing an opposed pair of film rolls mounted for counter rotation, joining free ends of the film between the rolls, passing an article to be wrapped between the rolls in a substantially vertical direction and allowing passage of the article between the rolls to draw film from the rolls and about the article and after the article has passed between the rolls sealing the film about the sides and upper surfaces of the article.

According to a further broad from of the invention there is provided a device for folding a foldable article, the device having a feed plate with a folding slot therein, a push arm moveable between a free position above the plate and a folding position below the plate and in use, the arm passes through the slot between the free and folding positions and pushes and folds an article though the slot.

The device of the present invention may be operated by mechanical, electrical or hydraulic means. Other suitable drive mechanisms may also be used. Generally a combination of electrical, hydraulic and mechanical means will be used to bring into effect the device of the present invention. It is preferred that the device be configured so as to minimise the noise generated by its operation.

Advantageously the present invention provides a process and a device for packaging articles, in particularly folded articles. The present invention has particular application to the packaging of newspapers so as to alleviate at least one of the problems mentioned above. Advantageously the newspaper can be packaged using the device of the present invention in a manner such that the mast head is readily visible through the packaging. In addition, sample materials may be conveniently included with the packaged newspaper for distribution to consumers.

The present invention will now be further described with reference to the accompanying drawings. The drawings and the description of the best method are provided to illustrate the present invention and to assist in a better understanding.

BEST MODE

Figure 1:
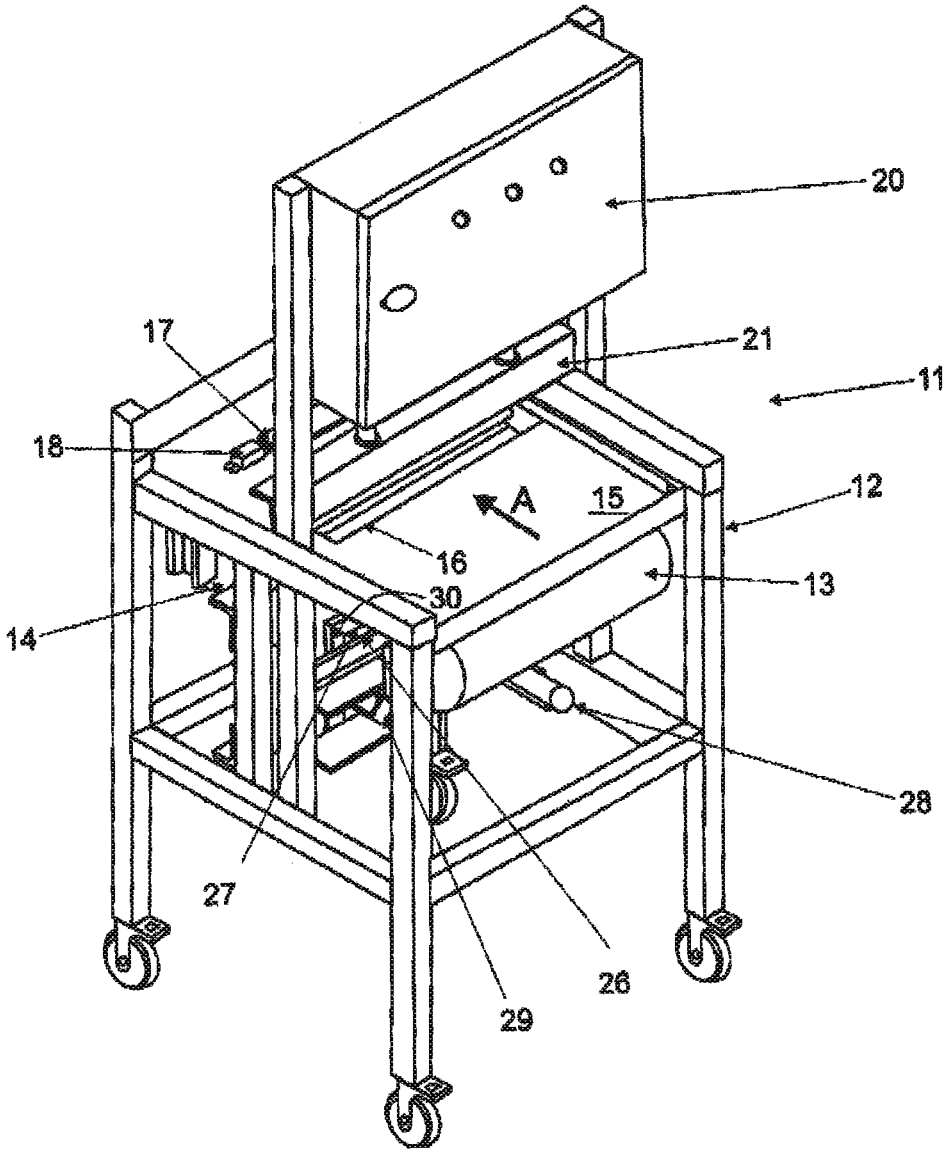
FIG. 1 is a perspective front view of a preferred device of the present invention.
Figure 2:
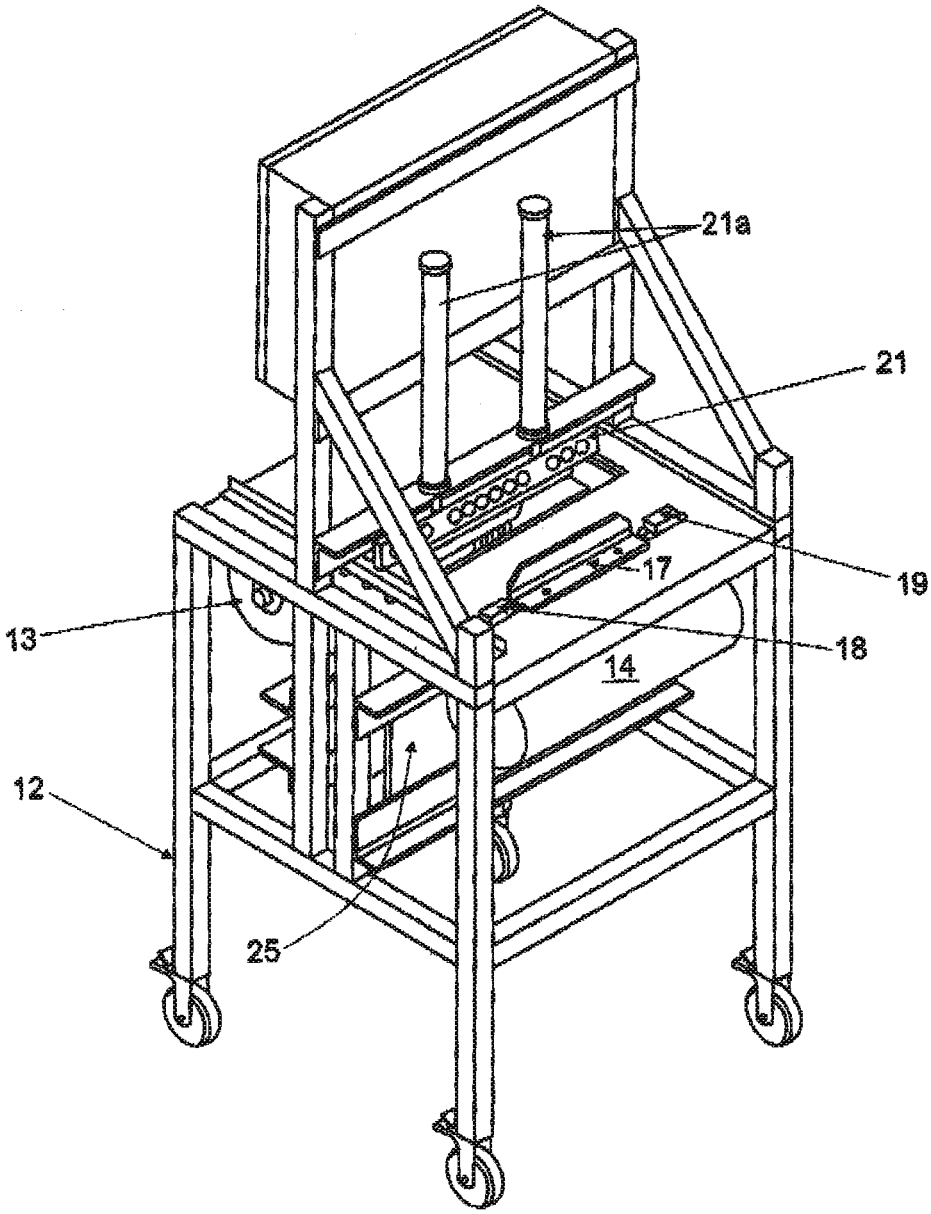
FIG. 2 is a rear perspective of the device of FIG. 1.
Figure 3:
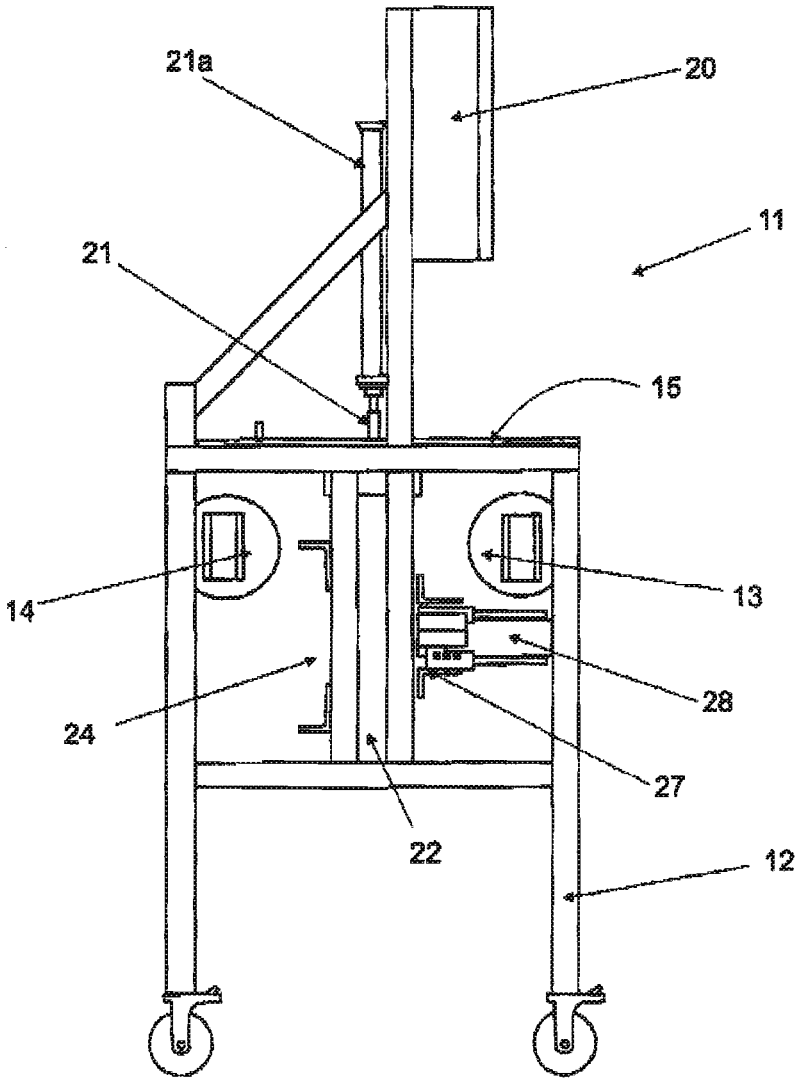
FIG. 3 is an end view of the device of FIG. 1.

FIG. 1 shows a preferred device 11 of the present invention which may be used for folding and wrapping a foldable article such as a newspaper or magazine. The device 11 has a frame 12 to which is rotatably mounted opposed counter rotating rollers 13,14. The device 11 has an upper feed plate 15 with a centrally located slot 16. At the rear of the plate 15 is a stop member 17. Starter switches 18, 19 are located on either side of stop member 17. As a paper is fed onto the plate 15 in the direction of arrow A, passage of the paper is stopped by stop member 17. The paper presses against and activates switches 18, 19 to begin the folding and wrapping process. Both switches must be activated to initiate the process. This ensures correct alignment of the paper. The switches feed an electronic signal to a control box 20.

The device 11 includes a horizontal pushing and folding arm 21 which can move between a free position as shown in FIG. 1 and a folding position in which the arm 21 has descended through the slot 16. Pneumatic rams 21*c* operate arm 21. A paper placed across the slot 16 will be folded about the arm 21 as the paper is pushed through slot 16.

Below the plate is a sealing chamber 22. To one side of the chamber is an anvil plate 25. To the other side is a rectangular press plate 26. The press plate is moveable between a free position (the position illustrated) and a press position in which the plate can press against anvil plate 25. Cylinder 28 controls movement of the press plate. The press plate serves to push excess air from between the paper and the film prior to sealing. A U shaped sealing plate 27 is located about the press plate. The sealing plate 26 is operated by a cylinder 29 between a free position (as illustrated) and a sealing position in which it abuts anvil plate 25. The sealing plate is electronically heated such that contact with the opposed anvil plate can weld the plastics film caught therebetween. The upper arm 30 of sealing plate 26 can both weld and separate the film. Typically, the upper arm can also rejoin the ends of the plastic rolls, ready for the next article to be wrapped.

In use the sequence of events is that the free ends of the film are joined such that film stretches across the sealing chamber 22. A paper is fed in the direction of arrow A across feed plate 15 until it meets stop member 17 and start switches 18, 19 are activated to begin the cycle. Push arm 21 pushes through slot 16 thereby folding the paper. Arm 21 and the folded paper enter sealing chamber 22. The pressure of the arm against the film passing across the chamber draws film from the rolls. As the article travels past the rolls, the arm 21 is withdrawn, press arm 26 is activated to press the paper against anvil plate 25 so as to more tightly fold the paper and remove excess air. Sealing arm 26 is then activated to seal the film about the folded paper and separate the sealed paper from the roll film. The free ends of the roll film are resealed by the sealing plate prior to the sealing plate returning to the free position. The folded and wrapped paper then falls and a further paper is fed to begin the cycle again.

It can be seen that the device of the present invention can be used to both fold and wrap a suitable article such as a newspaper. The wrapped article may be completely sealed so as to protect the wrapped article from the elements or make it suitable for postage. The device may wrap one or more papers at once. This may be desirable where multiple papers are being delivered to customers. Still further, advertising and promotional material may be included in the wrapped package. Such advertising material is not limited to paper articles (as is the case with including material in the conventional rolling and wrapping machines. Also, less plastic film is used than with conventional rolling machines. Still further, the device of the present invention generates significantly less noise than known rolling and wrapping machines. Still further a folded and wrapped newspaper may receive wide consumer acceptance due to increased as in unwrapping the paper.

Figure 4:
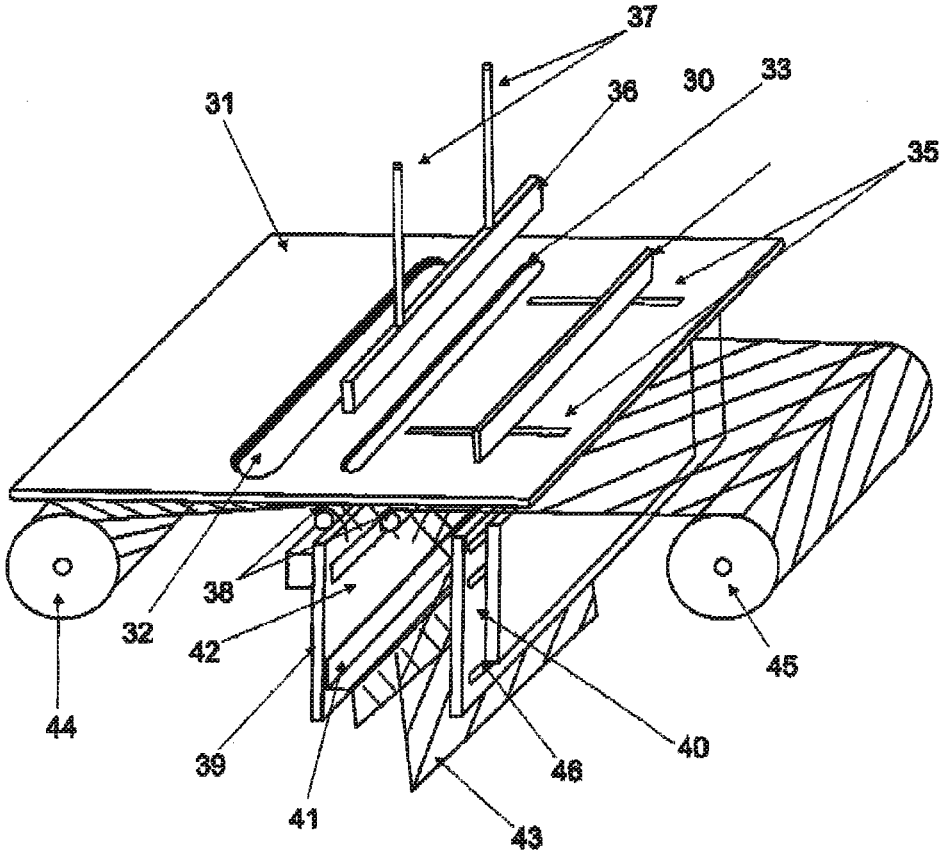
FIG. 4 is a perspective view of a wrapping device of an embodiment of the present invention.

FIG. 4 shows a wrapping device 30. The wrapping device 30 includes a table 31 having elongate slots 32 and 33. The table 31 has a stop 34 mounted on tracks 35 whereby the stop 34 may be positioned on the tracks 35 according to the size of the article to be folded and wrapped.

The wrapping device 30 has an arm 36 positioned above the table 31. The arm 36 is mounted on a pair of rams 37. The table 31 is positioned such that the desired elongated slot 33 is positioned immediately below and in the path of the arm 36. The elongated slot 33 is selected dependant upon the thickness of the article being folded.

As the article is pushed by the arm 36 through slot 33 rollers 38 engage the article and assist in positioning the article between the anvil 39 and the plate 40. Anvil 39 has a stop 41 that positions the article for sealing. The article is sealed between sheets 42 and 43. Sheets 42 and 43 are drawn from rolls 44 and 45 respectively. Once the article is positioned against stop 41 plate 40 is urged towards amble 39 to hold the respective sheets 42 and 43 and the article in place. Stop 41 is received within aperture 46 of plate 40.

Figure 5:
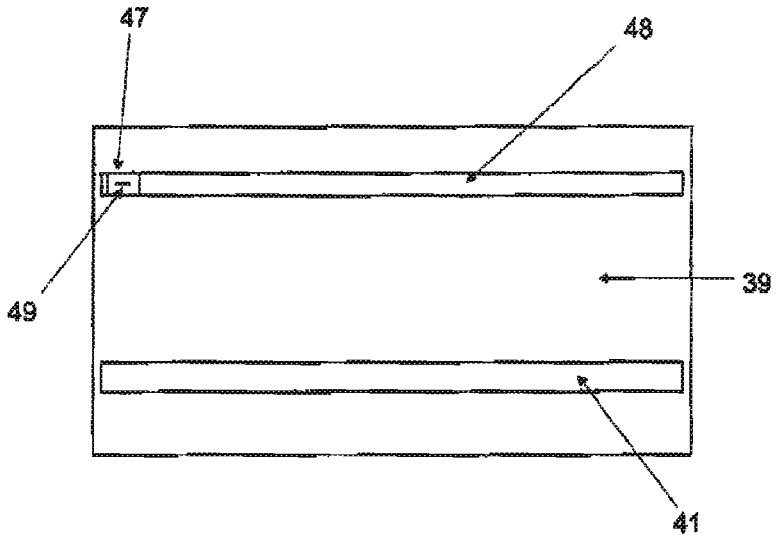
FIG. 5 is a plan view of the anvil of the wrapping device shown in FIG. 4.

FIG. 5 shows anvil 39. Anvil 39 has stop 41 mounted to locate the article. During or after the sealing process shuttle 47 moves through slot 48 so as to sever the wrapped article from the sheet drawn from rolls 44 and 45 respectively. The shuttle 47 has a blade 49 extending therefrom.

Figure 6:
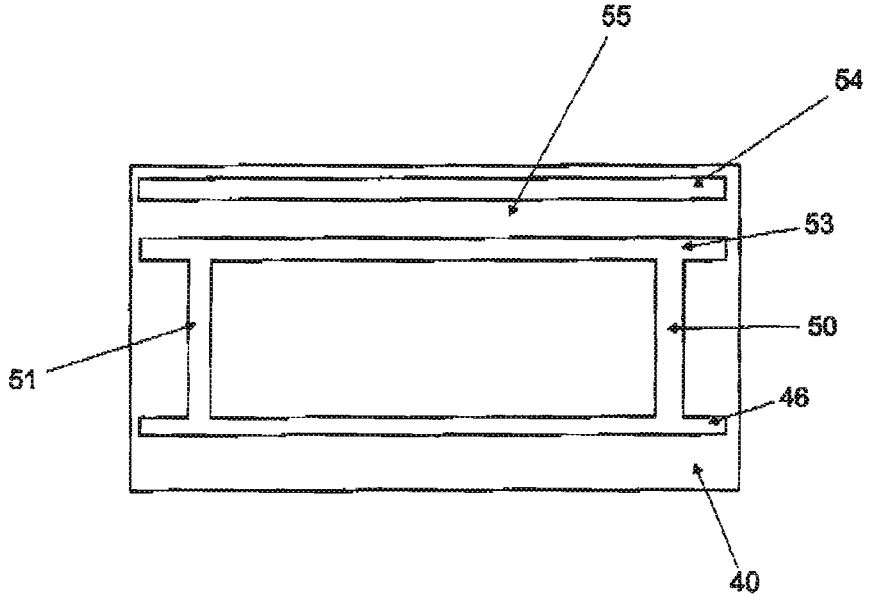
FIG. 6 is a plan view of the holding plate shown in FIG. 4.

FIG. 6 shows plate 40 having slot 46 extending there along. Slot 46 is for receiving stop 41. Plate 40 also has side slots 50 and 51 for receiving the heat sealing arms of the heat sealing mechanism 52. Plate 40 also has slot 53 for receiving the heat sealing arm for sealing the top of the packaged article. Slot 54 receives the heat sealing arm for sealing the sheets from rolls 44 and 45 respectively adjacent their leading edge with respect to the subsequent package. Surface 55 is used by the blade 49 to cut the plastic sheets.

Figure 7:
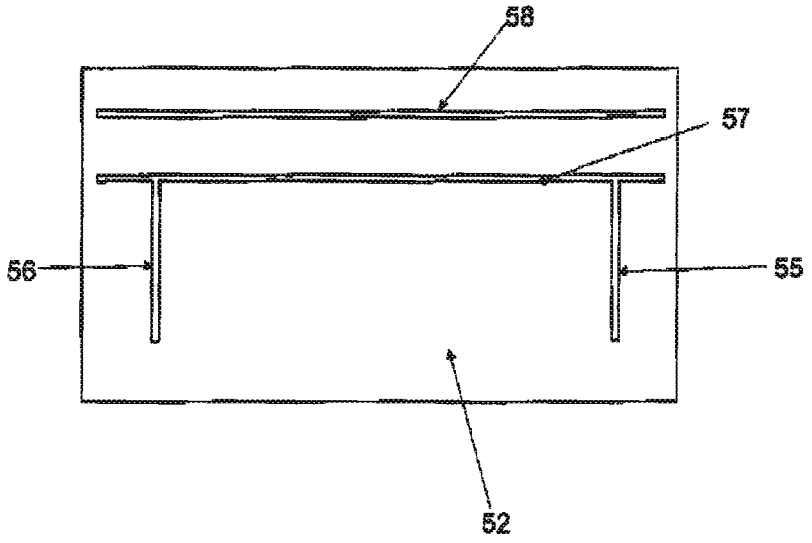
FIG. 7 is a plan view of a sealing arm shown in FIG. 4.

FIG. 7 shows the heat sealing mechanism having heat sealing arms 55 and 56 for being received into the slots 50 and 51 respectively. Heat sealing arm 57 is received within slot 53. Heat sealing arm 58 is received in slot 54. The heat sealing arms 55, 56, 57, 58 extend through the plate 40 and engage sheet 43 so as to heat seal sheet 43 to sheet 42.

Figure 8:
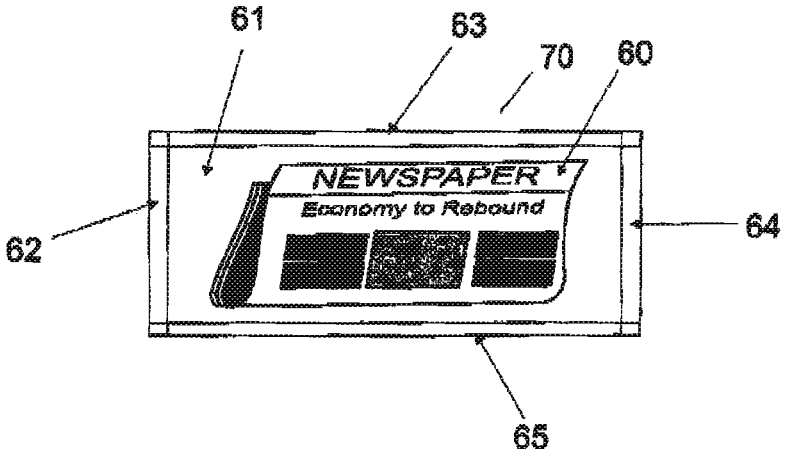
FIG. 8 is a top view of a newspaper wrapped in plastic film by the device shown in FIG. 4.

FIG. 8 shows a newspaper packaged within a wrap in accordance with the present invention. The newspaper 60 is held between plastic sheets 61 and heat seals 62, 63, 64 and 65 retain the newspaper within the package 70.

Figure 9:
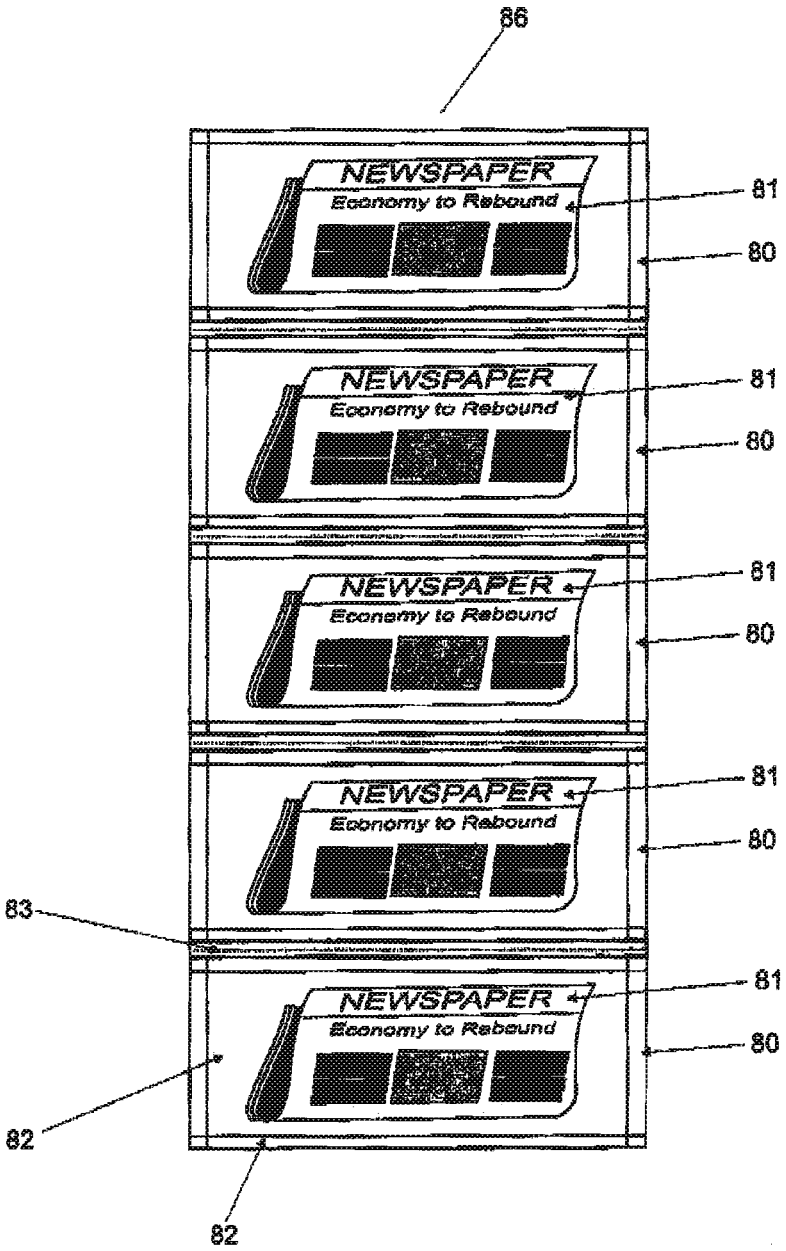
FIG. 9 is a top view of a series of newspapers wrapped with frangible interconnects therebetween.

FIG. 9 shows a plurality of packages 80 containing newspapers 81. The newspapers 81 are retained within packages 80 by heat seals 82. The packages 80 are joined by frangible connections 83. The string of newspapers 86 may be charged into a vending machine for sale of individually wrapped newspapers. The string or chain of newspapers may be readily thread through the dispenser as a person purchases an individual newspaper without providing the user with access to the remaining papers within the vending machine. The frangible connection 83 may be a perforated line along the width of the film used to wrap the newspapers 81.

It will be appreciated that various changes and modifications may be made to the invention as described herein without departing from the spirit and scope thereof.

The claims defining the invention are as follows:

1. A device for wrapping a plurality of articles sequentially, the device comprising a substantially planar support plate for supporting the articles, the support plate having at least one transverse opening therein, a first feeder for a first sheet of plastic film, a second feeder for a second sheet of plastic film, a carriage moveable between a free position above the substantially planar support plate and a folding position below the substantially planar support plate for positioning the article between the first and second sheets of plastic film, wherein the article is placed on the support plate and the carriage pushes the article through the at least one transverse opening to accomplish folding of the article, a pair of opposed plates cooperating to evacuate excess air from between the first and second sheets of plastic film, and a sealing mechanism for sealing the first and second sheets of plastic film together adjacent the periphery of the article, wherein sealing of the first and second sheets of plastic film together to close about a first article forms a top seal and concurrently:

a) forms a base seal between the first and second sheets of plastic film to form a containing portion for receiving a subsequent article, the base seal remaining below the transverse opening and, when abutted by the subsequent article being pushed through the transverse opening, forcing deployment of the first sheet of plastic film and the second sheet of plastic film from the first and second feeders; and b) separates the first article from the subsequent article between the top seal of the first article and the base seal of the subsequent article.

2. A device for wrapping an article according to claim 1 wherein the carriage operates to fold the article prior to wrapping.

3. A device for wrapping an article according to claim 2 wherein the carriage includes a pushing arm for urging an article at an intermediate position along the article through the at least one transverse opening, whereby the article is folded.

4. A device for wrapping an article according to claim 1 wherein the carriage reciprocates between a primed condition and an engaged condition.

5. A device for wrapping an article according to claim 1 wherein the article is foldable.

6. A device for wrapping an article according to claim 1 wherein the article is selected from the group consisting of newspapers, magazines, textile products and combinations thereof.

7. A device for wrapping an article according to claim 6 wherein an additional article is included with the foldable article.

8. A device for wrapping an article according to claim 7 wherein the additional article is selected from the group consisting of a CD, a sample pack of shampoo, a sample pack of cleaning materials, a sample pack of toothpaste, a sample pack of snack foods, a sample pack of tea and a sample pack of coffee.

9. A device for wrapping an article according to claim 1 wherein the first and second sheets of plastic films are formed from polyethylene.

10. A device for wrapping an article according to claim 1 wherein the first feeder and second feeder are rolls containing plastic film sheet.

11. A device for wrapping an article according to claim 10 wherein the rolls of the device are aligned horizontally.

12. A device for wrapping an article according to claim 10 wherein the rolls are mounted for rotation whereby film is drawn from the rolls as the article passes therethrough.

13. A device for wrapping an article according to claim 1 wherein the carriage positions the article vertically between the first and second sheets of plastic film.

14. The device according to claim 1 wherein at least one of the pair of plates converges towards the other of said pair of plates thereby removing excess air from between the first and second sheets of plastic film.

15. The device according to claim 1 wherein the sealing mechanism seals each article within the first and second sheets of plastic film without splitting the plastic film between successive articles thereby forming a continuous string of individually wrapped articles.

16. The device according to claim 15 wherein the sealing mechanism forms a frangible connection in the plastic film between successive articles thereby allowing each individually wrapped article to be separated from the continuous string of individually wrapped articles.

17. The device according to claim 1 wherein the sealing mechanism forms a top seal enclosing a first article within a containing portion formed with the first and second sheets of plastic film, the sealing mechanism concurrently forming a base seal between the first and second sheets of plastic film to form the containing portion for receiving a second article and splitting the film between the first article top seal and the second article base seal to separate the first article from the second article.

18. A method of wrapping an article, the method including providing an opposed pair of film rolls mounted for counter rotation, joining free ends of the film between the rolls, supporting an article to be wrapped on a support plate defining a transverse opening, passing the article through the transverse opening to accomplish folding of the article, passing the folded article between the opposed pair of film rolls in a substantially vertical direction and allowing passage of the article between the opposed pair of film rolls to draw film about the article to form a partially wrapped article, squeezing excess air from the partially wrapped article, and, after squeezing excess air from the partially wrapped, sealing the film about the sides and upper surfaces of the article, closing the film from the opposed pair of film rolls together about a first article to form a top seal and to concurrently form a base seal creating a containing portion to receive a subsequent article, the base seal remaining below the transverse opening and when abutted by the article pushed through the transverse opening, forcing the deployment of film from the opposed pair of film rolls, and separating the first article from the subsequent article between the top seal of the first article and the base seal of the subsequent article.

19. A device for wrapping a plurality of articles sequentially, the device comprising a substantially planar support plate for supporting the articles, the support surface having at least one transverse opening therein, a first feeder for a first sheet of plastic film, a second feeder for a second sheet of plastic film, a carriage moveable between a free position above the substantially planar support surface and a folding position below the substantially planar support surface for positioning the article between the first and second sheets of plastic film wherein the article is placed on the support surface and the carriage pushes the article through the at least one transverse opening to fold the article and a sealing mechanism for sealing the first and second sheets of plastic film together adjacent the periphery of the article, wherein sealing of the first and second sheets of plastic film together to close about a first article forms a top seal and forms a base seal between the first and second sheets of plastic film to form containing portion to receive a subsequent article without separating the plastic film forming a continuous string of articles each sealed in an individual section, the base seal remaining below the transverse opening and when abutted by the article pushed through the transverse opening, forcing the deployment of plastic film from the first and second feeders.

20. A device for wrapping a plurality of articles sequentially as claimed in claim 19 wherein a frangible connection is formed in the plastic film between the articles concurrently with the sealing.

* * * * *